United States Patent [19]

Streck

[11] Patent Number: 4,865,224

[45] Date of Patent: Sep. 12, 1989

[54] SQUEEZE TO EMPTY BOTTLE

[75] Inventor: Donald A. Streck, Ojai, Calif.

[73] Assignee: Jerry R. Iggulden, Newhall, Calif. ; a part interest

[21] Appl. No.: 216,288

[22] Filed: Jul. 8, 1988

[51] Int. Cl.[4] ..... B65D 35/28

[52] U.S. Cl. ..... 222/95; 222/105; 222/213; 222/386.5; 222/1

[58] Field of Search ..... 222/95, 105, 206, 213, 222/215, 209, 183, 386.5, 1; 215/11.3, 11.5

[56] References Cited

U.S. PATENT DOCUMENTS

| | | | |
|---|---|---|---|
| 1,695,076 | 12/1928 | Zohe | 215/11.3 |
| 2,816,690 | 12/1957 | Lari | 222/215 |
| 3,157,314 | 11/1964 | Nadler | 222/215 |
| 3,223,289 | 12/1965 | Bouet | 222/95 |
| 3,837,533 | 9/1974 | Splan | 222/209 |
| 4,159,790 | 7/1979 | Bailey | 222/386.5 |
| 4,469,250 | 9/1984 | Evezich | 222/95 |

FOREIGN PATENT DOCUMENTS

| | | | |
|---|---|---|---|
| 2304538 | 8/1974 | Fed. Rep. of Germany | 222/95 |

*Primary Examiner*—H. Grant Skaggs
*Attorney, Agent, or Firm*—Donald A. Streck

[57] ABSTRACT

A method of manufacturing and using a plastic bottle for dispensing thick, viscous liquids while preventing the drying and thickening thereof. The bottle is manufactured by attaching a top edge of a thin-walled, plastic, liquid-containing bag to a cylindrical collar; rolling the bag on the collar to form the bag into a long, thin roll extending from the collar; inserting the rolled bag through the neck portion of a closed hollow bottle body having sidewalls of a squeezable, self-restoring plastic and a cylindrical neck portion extending therefrom; attaching the collar to the top of the neck portion of the bottle body; and, providing a one way valve in the bottle to allow air into the space between the inside of the bottle body and the bag but not allow it out. After filling the bag with the liquid, the bottle is used by periodically, repeatedly squeezing the bottle body to pressurize air thereby pumped through the valve into the space between the inside of the bottle body and the bag and thereby force the bag against the liquid in the bag under pressure whereby the area of the liquid exposed to air in the bag is minimized and the liquid if forced out of the bag under pressure. The valve is a duckbill valve disposed in a tube extending from the collar or in a bore through the bottle body.

5 Claims, 4 Drawing Sheets

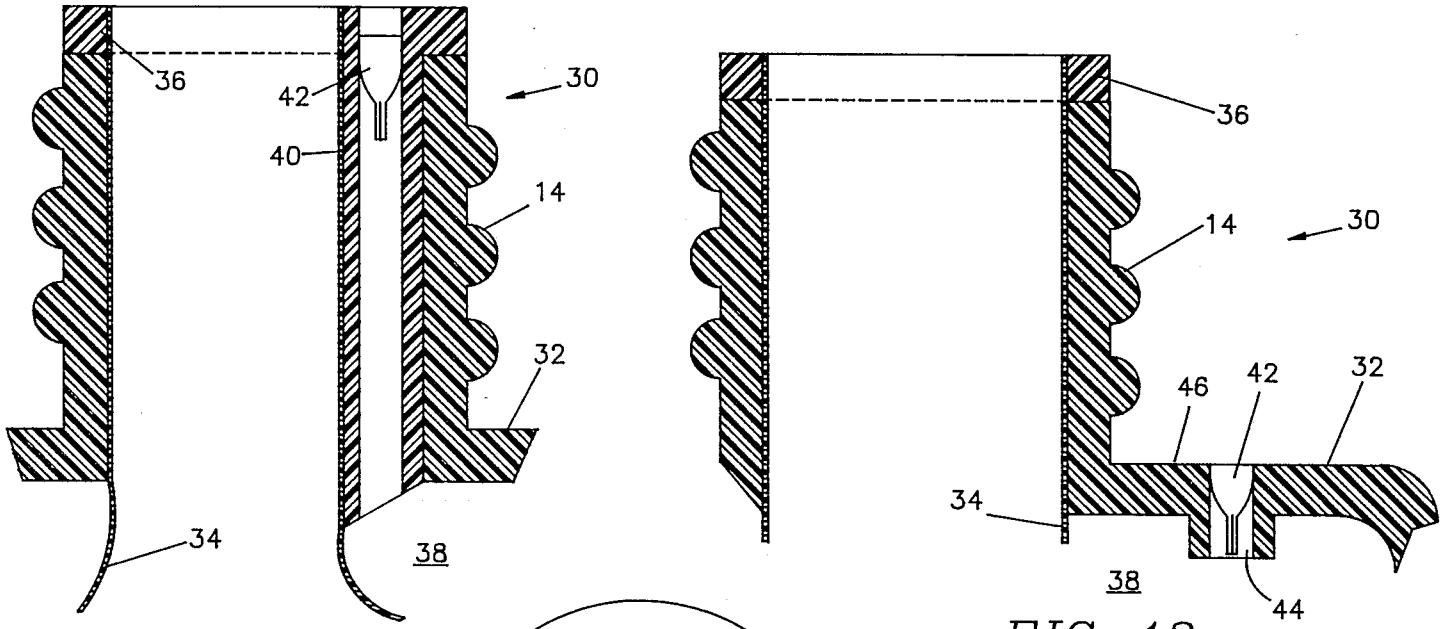
FIG. 12
FIG. 10
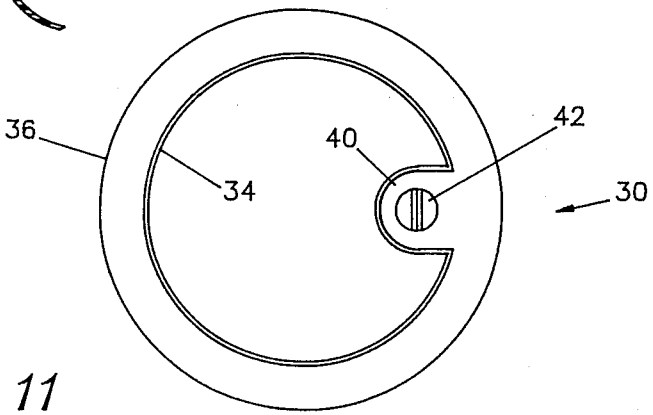
FIG. 11

SQUEEZE TO EMPTY BOTTLE

BACKGROUND OF THE INVENTION

The present invention relates to plastic bottles used for storing and dispensing thick, viscous liquids and, more particularly, in a plastic bottle having a closed body of a squeezable plastic attached to a cylindrical neck portion, to the improvement to provide ease of dispensing thick, viscous liquids while preventing the drying and thickening thereof comprising, a thin-walled, plastic, liquid-containing bag inserted into the body and attached about an inner periphery of the neck portion; and, valve means positioned between the atmosphere outside of the bottle and a space between the body and said bag for permitting air to flow into said space but not out of said space.

Since their availability, plastic bottles, such as that generally indicated as 10 in FIG. 1, have been employed with great favor in the storing and dispensing of liquids. The bottle 10 typically comprises a body portion 12 with a threaded neck portion 14 projecting upward therefrom. In this regard, the plastic bottles 10 are substantially identical to the glass bottles that they replaced for many uses. Being of plastic, however, they provide many attributes that their glass predecessor do not. For one, they bounce when dropped in the shower, tub, or the like. This makes them much safer for the holding and dispensing of thick, viscous liquids like shampoo, hair conditioner, and the like. Moreover, as illustrated in FIG. 2, they have the additional benefit of being squeezable. When the bottle 10 is inverted and its sides squeezed as symbolized by the arrows, the incompressible liquid 16 therein is forced from the bottle. Because of this feature, many bottles have caps that do not have to be removed from the threaded neck 14 in order to dispense the liquid 16. These caps have tip to activate valves or flip on/off coverings over a dispensing hole.

Prior art plastic bottles such as 10 work well when they are full; however, as the liquid 16 in the bottle 10 diminishes, so does the acceptable performance. By the time the condition of FIG. 3 exists, so do problems in getting the liquid 16 out of the bottle 10. For one thing, the amount of the liquid 16 and, therefore, the weight of it is small. Moreover, the amount of air 18 above the liquid 16 is great. This is very often exacerbated by the user leaving the top in a open state at all times so that the air 18 is open to the atmosphere. As a result, the liquid 16 tends to dry out and thicken beyond its original thick, viscous state; that is, it becomes even thicker and less prone to "flow". In the extreme, it becomes the consistency of Jello. As all this takes place, the user finds the dispensing process becomes like that illustrated in FIGS. 4–7. When the bottle 10 is inverted for use, the liquid 16 starts to slowly leave the bottom of the bottle 10 under the force of gravity (FIG. 4). It moves slowly down the side of the bottle 10 towards the neck 14 (FIG. 5). It finally reaches the neck end of the bottle 10; but, until it closes the hole leading out of the neck 14 all the squeezing in the world does not help (FIG. 6). Finally, it flows into the neck 14 and squeezing of the sides forces the liquid out the neck 14 (FIG. 7).

In a related area of the bottle art, it was a common problem in bottles used for dispensing baby formula, and the like, for the infant to ingest large quantities of air along with the formula when a nipple was attached to the neck portion of a bottle such as 10 in FIG. 1 (either in glass or plastic). To solve this problem, the two-part bottle 20 of FIG. 8 was introduced. Bottle 20 comprises a rigid cylindrical sleeve 22 which is open at the bottom. A thin plastic bag 24 is inserted into the sleeve 22, folded over the top edge, and held in place with a plastic or rubber nipple 26. The formula 28 is placed in the bag 24. As the infant sucks the formula 28 from the bag 24, air entering the open end of the sleeve is free to collapse the bag 24 about the formula 28. As a result, very little air, if any, is ingested by the infant during feeding.

Wherefore, it is an object of the present invention to provide a plastic bottle for the storing and dispensing of thick, viscous liquids which prevents the liquid from getting dried out and thick from air exposure as the bottle is emptied.

It is another object of the present invention to provide a plastic bottle for the storing and dispensing of thick, viscous liquids which allows the liquid to be pumped from the bottle by squeezing the sides as the bottle is emptied.

It is still another object of the present invention to provide a plastic bottle for the storing and dispensing of thick, viscous liquids which allows the liquid to be pumped from the bottle by squeezing the sides without having to wait for the liquid to slowly flow from the bottom to the top when the bottle is inverted.

Other objects and benefits of the present invention will become apparent from the description which follows hereinafter when taken in conjunction with the drawing figures which accompany it.

SUMMARY:

The foregoing objects have been achieved by the method of manufacturing and using a plastic bottle for dispensing thick, viscous liquids while preventing the drying and thickening thereof according to the present invention comprising the steps of, manufacturing the bottle by, attaching a top edge of a thin-walled, plastic, liquid-containing bag to a cylindrical collar;

rolling the bag on the collar to form the bag into a long, thin roll extending from the collar;

inserting the rolled bag through the neck portion of a closed hollow bottle body having sidewalls of a squeezable, self-restoring plastic and a cylindrical neck portion extending therefrom;

attaching the collar to the top of the neck portion of the bottle body; and, providing a one way valve in the bottle to allow air into the space between the inside of the bottle body and the bag but not allow it out;

then, filling the bag with the liquid; and thereafter using the bottle by periodically, repeatedly squeezing the bottle body to pressurize air thereby pumped through the valve into the space between the inside of the bottle body and the bag and thereby force the bag against the liquid in the bag under pressure whereby the area of the liquid exposed to air in the bag is minimized and the liquid if forced out of the bag under pressure.

In the preferred embodiment, the step of providing a one way valve in the bottle comprises the steps of, forming a tube into the cylindrical collar and perpendicular thereto; inserting a one way valve into the tube; and, positioning the cylindrical collar on the neck portion with the tube extending from the cylindrical collar at a top end thereof along an inner surface of the neck portion to an inner portion of the bottle body at a bottom end thereof.

In an alternate embodiment, the step of providing a one way valve in the bottle comprises forming a bore through a sidewall of the bottle body and inserting a one way valve into the bore.

DESCRIPTION OF THE DRAWINGS

FIG. 1 is a cutaway elevation drawing of an empty plastic bottle according to the prior art as used for storing and dispensing thick, viscous liquids.

FIG. 2 is a cutaway elevation drawing of the plastic bottle of FIG. 3 when inverted and dispensing a full bottle of a thick, viscous liquid.

FIGS. 4–7 are cutaway elevation drawings of the plastic bottle of FIG. 1 when dispensing from an almost empty bottle of a thick, viscous liquid.

FIG. 8 is a cutaway elevation drawing of a two-part plastic bottle as employed in the prior art for holding and dispensing infant formula, and the like.

FIG. 10 is an enlarged, cutaway elevation drawing of the neck portion of a two-part plastic according to the present invention with the valve employed therein in the preferred embodiment specifically shown.

FIG. 11 is a top view of the embodiment of FIG. 10.

FIG. 12 is an enlarged, cutaway elevation drawing of the neck portion of a two-part plastic according to the present invention with the valve employed therein in an alternate embodiment specifically shown.

Figures 1, 2, 3, 4, 5, 6, 7, 8:
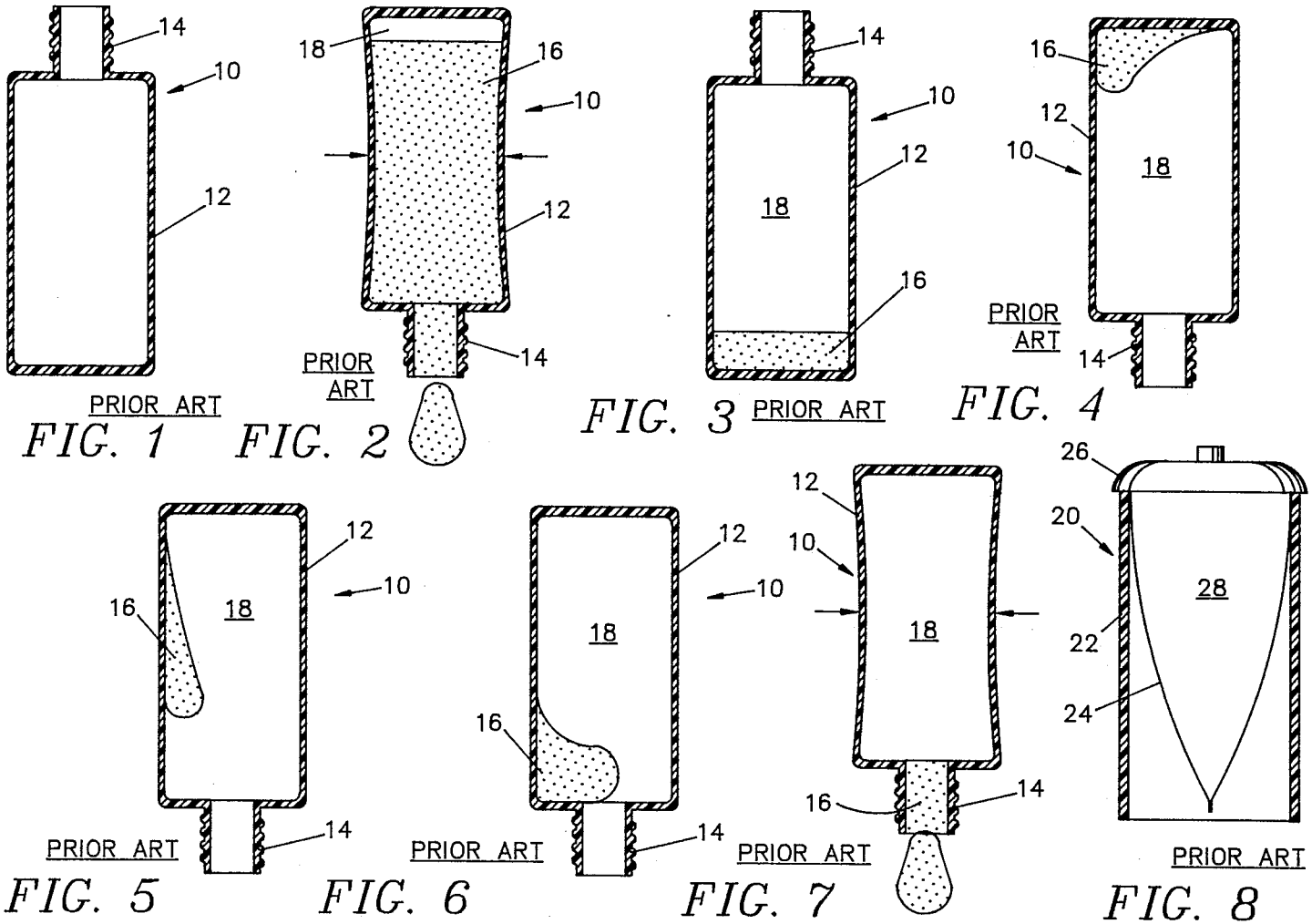
FIG. 1 PRIOR ART
FIG. 2 PRIOR ART
FIG. 3 PRIOR ART
FIG. 4 PRIOR ART
FIG. 5 PRIOR ART
FIG. 6 PRIOR ART
FIG. 7 PRIOR ART
FIG. 8 PRIOR ART
Figure 9:
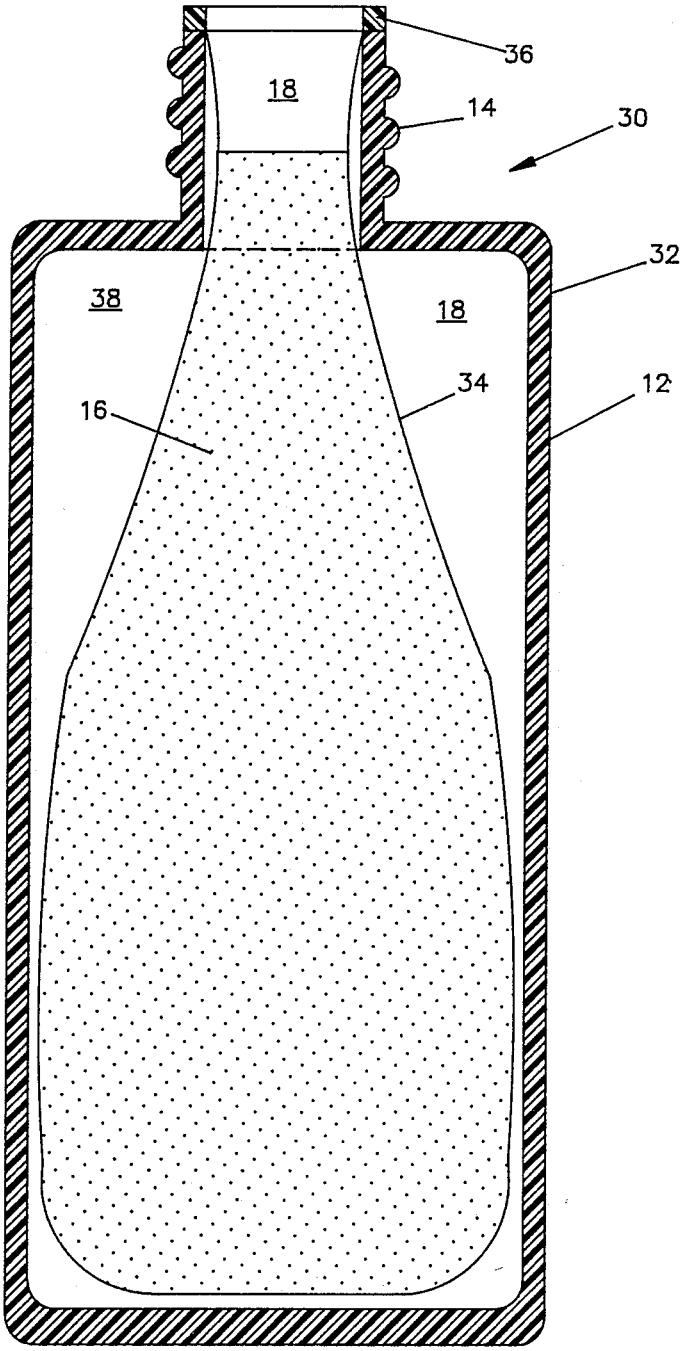
FIG. 9 is an enlarged, cutaway elevation drawing of a two-part plastic according to the present invention with the valve employed therein not specifically shown.
Figure 16:
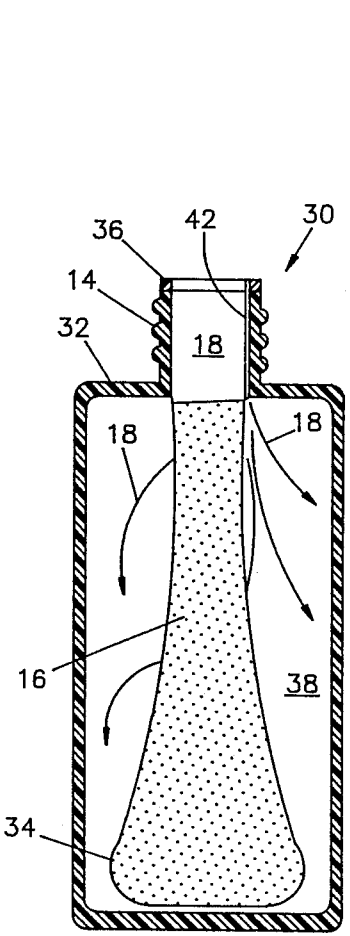
FIG. 16 a cutaway elevation drawing of a two-part plastic according to the present invention illustrating how after squeezing the plastic bottle housing to transfers air pressure to and squeeze the liquid-containing bag, releasing the squeezing force allows air to enter the space between the plastic bottle housing and squeeze the liquid-containing bag through the valve.

DESCRIPTION OF THE PREFERRED EMBODIMENT:

The bottle of the present invention is shown in simplified form in FIG. 9 where it is generally indicated as 30. Bottle 30 comprises a thick-walled plastic bottle housing 32 of a plastic such as polyethylene, or the like. With the preferred embodiment, the housing 32 can be a plastic bottle such as bottle 10 of FIG. 1 having a body portion 12 and a neck portion 14. A liquid-containing bag 34 is inserted into the housing 32 and filled with the liquid 16 to be dispensed. Note that in the preferred embodiment, the bag 34 is attached to a collar 36 which is, in turn, attached to the top of the neck portion 14 of the housing 32. As can be seen, the bottom of the bottle housing 32 is closed. Thus, with the collar 36 attached to the top of the neck portion 14 (adhesively or with a press fit), the space 38 between the inside of the housing 32 and outside of the bag 34 is a sealed system. Though the use of an appropriately placed valve (not shown in this drawing but to be described shortly in two embodiments), the air 18 in the space 38 can be pressurized and, thereby, squeeze the bag 34 to dispense the liquid therein.

Turning next to FIGS. 10 and 11, the valve system according to the preferred embodiment is shown therein. This version is preferred in that the present invention can be a retrofit to conventional plastic bottles such as 10 of FIG. 1; that is, the plastic bottle 10 can function as the bottle housing 32 without any change thereto. In this embodiment, the collar 36 has a valve tube 40 formed as part thereof. When the collar 36 is positioned on the neck 14, the valve tube 40 is disposed alone the inner surface of the neck 14 communicating between the atmosphere on the outside and the space 38 on the inside. The bag 34 extends downward from the collar 36 alongside the tube 40. A simple so-called "duckbill" valve 42 is press fitted into the tube 40. Valve 42 is preferably of plastic and is positioned to permit air flow into, but not out of, space 38.

In an alternate embodiment requiring modification to the bottle 10 to form the bottle housing 32 as shown in FIG. 12, the valve 42 is inserted into a bore 44 formed into the sidewall 46 of the housing 32 for the purpose.

Figure 15:
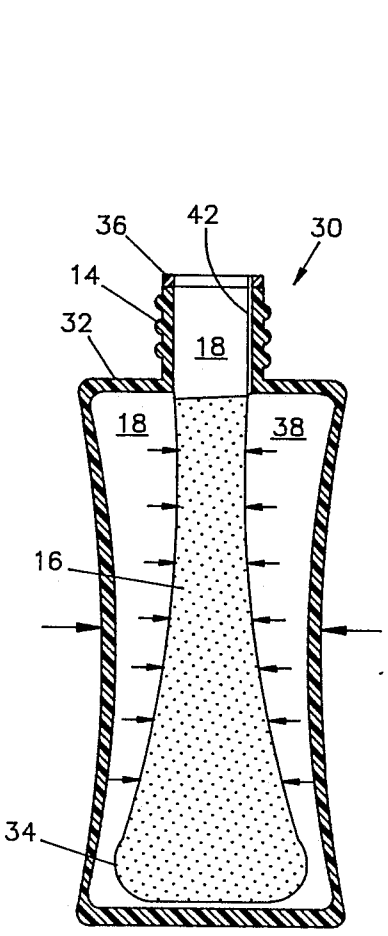
FIG. 15 a cutaway elevation drawing of a two-part plastic according to the present invention illustrating how squeezing the plastic bottle housing transfers air pressure to and squeezes the liquid-containing bag.
Figure 14:
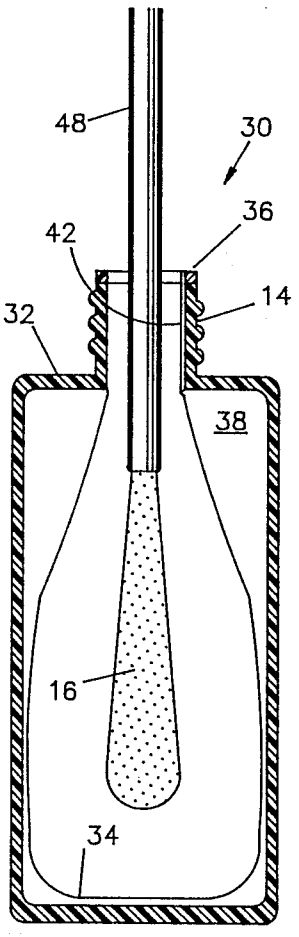
FIG. 14 is a cutaway elevation drawing of a two-part plastic according to the present invention with the preferred valve of FIGS. 10 and 11 the valve collar and attached liquid-containing bag inserted into the plastic bottle housing and in the process of having the liquid-containing bag filled with liquid.
Figure 13:
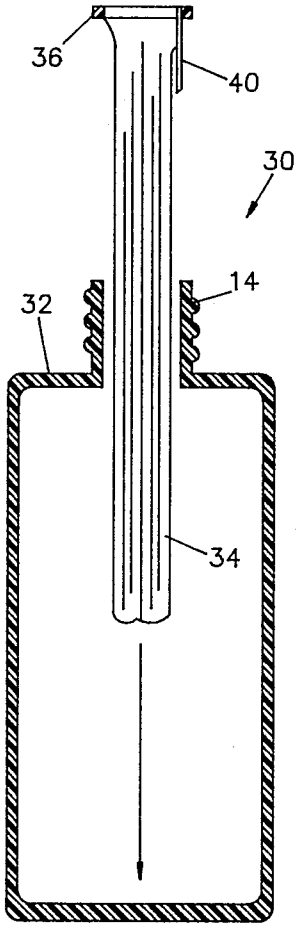
FIG. 13 is a cutaway elevation drawing of a two-part plastic according to the present invention with the preferred valve of FIGS. 10 and 11 in the process of having the valve collar and attached liquid-containing bag inserted into the plastic bottle housing.

The manner of assembly, filling, and use of the present invention in its preferred embodiment is depicted in FIGS. 13–16. As shown in FIG. 13, the bag 34 as attached to the collar 36 is rolled into a long, thin, cylindrical shape so as to be insertible into the bottle housing 32 through the neck 14. The bag 34 is then so inserted into the housing 32 and the collar 36 attached to the top o the neck. A filling tube 48 is then inserted through the collar 36 and the liquid 16 injected into the bag 34. If desired, a puff of air or inert gas under pressure can precede the liquid 16 to unfurl the bag 34 in preparation for accepting the liquid 16. When the bottle housing 32 is squeezed as shown in FIG. 15, the air 18 trapped in the housing 32 is compressed and, in turn, squeezes the bag 34. When the squeezing pressure is released, air 18 flows into the space 38 through the valve 42. By repeatedly squeezing the housing 32, the user can build up a pressure within the space 38 tending to force the liquid 16 out of the bag 34. The amount of pressure will be determined by the thickness of the sidewalls of the housing 32 and, therefore, their inherent, self-biasing restorative force. Note that since the bag 34 is forced around the liquid 16, as the liquid 16 is consumed, the only portion exposed to air so as to cause evaporation is that portion adjacent the neck 14.

Thus, it can be seen that the bottle of the present invention has met its stated objectives by providing a holding and dispensing environment which tends to avoid drying and thickening of the product as it is used and, additionally, aids in its dispensing through a pumping action obtained by repeatedly squeezing the bottle.

Wherefore, having thus described my invention, what is claimed is:

1. In a plastic bottle having a closed body of a squeezable plastic attached to a cylindrical neck portion, the improvement to provide ease of dispensing thick, viscous liquids while preventing the drying and thickening thereof comprising:

(a) a thin-wallet, plastic, liquid-containing bag inserted into the body and attached about an inner periphery of the neck portion;

(b) valve means positioned between the atmosphere outside of the bottle and a space between the body and said bag for permitting air to flow into said space but not out of said space; and, (c) a cylindrical collar having a top edge of said bag attached thereto attached to the top of the neck portion with said bag extending downward therefrom into the body; and wherein said valve means comprises, (d) a tube extending from said cylindrical collar at a top end thereof along an inner surface of the neck portion to an inner portion of the body at a bottom end thereof; and, (e) a one way valve inserted into said tube.

2. The improvement to a plastic bottle of claim 1 wherein:

said valve is a duckbill valve.

3. A plastic bottle particularly suited for dispensing thick, viscous liquids while preventing the drying and thickening thereof comprising:

(a) a closed hollow body portion having sidewalls of a squeezable, self-restoring plastic and having a cylindrical neck portion extending therefrom;

(b) a thin-walled, plastic, liquid-containing bag inserted into said body portion and attached about an inner periphery of said neck portion;

(c) a cylindrical collar having a top edge of said bag attached thereto attached to the top of said neck portion with said bag extending downward therefrom into said body portion; and, (d) valve means positioned between the atmosphere outside of the bottle and a space between said body portion and said bag for permitting air to flow into said space but not out of said space, said valve means comprising (d1) a tube extending from said cylindrical collar at a top end thereof along an inner surface of said neck portion to an inner portion of said body portion at a bottom end thereof, and (d2) a one way valve inserted into said tube.

4. The plastic bottle of claim 3 wherein: said valve is a duckbill valve.

5. The method of manufacturing and using a plastic bottle for dispensing thick, viscous liquids while preventing the drying and thickening thereof comprising the steps of:

(a) manufacturing the bottle by, (a1) attaching a top edge of thin-walled, plastic, liquid-containing bag to a cylindrical collar;

(a2) rolling the bag on the collar to form the bag into a long, thin roll extending from the collar;

(a3) inserting the rolled bag through the neck portion of a closed hollow bottle body having sidewalls of a squeezable, self-restoring plastic and a cylindrical neck portion extending therefrom;

(a4) attaching the collar to the top of the neck portion of the bottle body; and, (a5) providing a one way valve in the bottle to allow air into the space between the inside of the bottle body and the bag but not allow it out by the steps of, (a51) forming a tube into the cylindrical collar and perpendicular thereto, (a52) inserting a one way valve into the tube, and (a53) positioning the cylindrical collar on the neck portion with the tube extending from the cylindrical collar at a top end thereof along an inner surface of the neck portion to an inner portion of the bottle body at a bottom end thereof; then, (b) filling the bag with the liquid; and thereafter using the bottle by, (c) periodically, repeatedly squeezing the bottle body to pressurize air thereby pumped through the valve into the space between the inside of the bottle body and the bag and thereby force the bag against the liquid in the bag under pressure whereby the area of the liquid exposed to air in the bag is minimized and the liquid if forced out of the bag under pressure.

* * * * *